US008651076B2

(12) United States Patent
Walliser et al.

(10) Patent No.: US 8,651,076 B2
(45) Date of Patent: Feb. 18, 2014

(54) ADJUSTING SYSTEM FOR CAMSHAFTS OF AN INTERNAL COMBUSTION ENGINE

(75) Inventors: Jochen Walliser, Kressbronn (DE); Frank Richter, Oberteuringen (DE); Ewald Schmitz, Daisendorf (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 115 days.

(21) Appl. No.: 13/128,833

(22) PCT Filed: Oct. 20, 2009

(86) PCT No.: PCT/EP2009/063746
§ 371 (c)(1),
(2), (4) Date: Jun. 3, 2011

(87) PCT Pub. No.: WO2010/054915
PCT Pub. Date: May 20, 2010

(65) Prior Publication Data

US 2011/0253086 A1 Oct. 20, 2011

(30) Foreign Application Priority Data

Nov. 12, 2008 (DE) ..... 10 2008 043 671

(51) Int. Cl.
*F01L 1/34* (2006.01)

(52) U.S. Cl.
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS

| | | | |
|---|---|---|---|
| 7,032,552 | B2 | 4/2006 | Schäfer et al. |
| 2006/0236967 | A1 | 10/2006 | Gregor et al. |
| 2007/0199532 | A1 | 8/2007 | Meintschel et al. |
| 2007/0204825 | A1 | 9/2007 | Watanabe |
| 2008/0053389 | A1 | 3/2008 | Schafer et al. |
| 2008/0105078 | A1 | 5/2008 | Gregor et al. |
| 2009/0095124 | A1 | 4/2009 | Richter |

FOREIGN PATENT DOCUMENTS

| | | | |
|---|---|---|---|
| DE | 10220687 | A1 | 11/2003 |
| DE | 10224445 | A1 | 12/2003 |
| DE | 10355560 | A1 | 8/2005 |
| DE | 102004033522 | A1 | 2/2006 |
| DE | 102004043548 | A1 | 4/2006 |
| DE | 102004045631 | A1 | 4/2006 |
| DE | 102005022201 | B3 | 6/2006 |
| DE | 102005037158 | A1 | 2/2007 |
| DE | 102006011806 | A1 | 10/2007 |
| EP | 254058 | A2 | 1/1988 |
| EP | 274019 | A1 | 7/1988 |
| WO | WO 03-102381 | A1 | 12/2003 |

OTHER PUBLICATIONS

International Search Report for International Application No. PCT/EP2009/063746, dated Jan. 29, 2010, 3 pages.

*Primary Examiner* — Zelalem Eshete
(74) *Attorney, Agent, or Firm* — Brinks Gilson & Lione

(57) ABSTRACT

An adjusting system for camshafts of an internal combustion engine having an emergency running function, comprising a phase shifter gearing with an input drive element driven by a crankshaft of an internal combustion engine, an output drive element which drives a camshaft of the internal combustion engine, and an actuating element, by means of which a relative rotation between the drive input element and the drive output element can be realized by means of a device for imparting a braking torque, which is variable for normal operation, to the actuating element. In the event of failure of the device and/or control thereof, an emergency running setting of the camshaft can be attained and maintained as a result of braking or respectively, arresting the actuating element.

16 Claims, 2 Drawing Sheets

ADJUSTING SYSTEM FOR CAMSHAFTS OF AN INTERNAL COMBUSTION ENGINE

Figure 1:
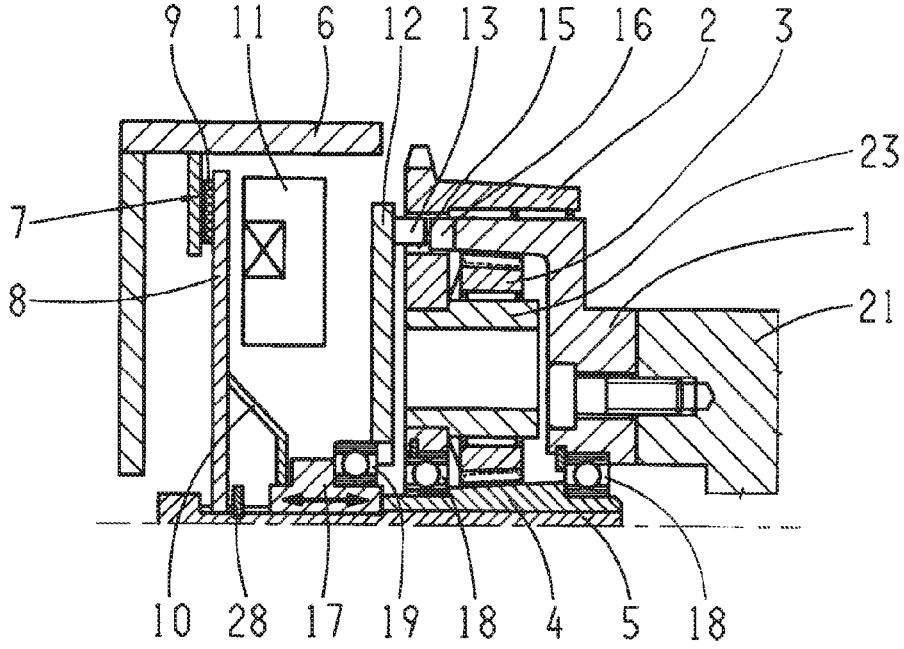

This application is a filing under 35 U.S.C. §371 of International Patent Application PCT/EP2009/063746, filed Oct. 20, 2009, which claims priority to German Application No. 10 2008 043 671.2, filed Nov. 12, 2008, each of which is hereby incorporated by reference herein in its entirety.

An adjusting system for camshafts of internal combustion engines with an emergency running function, comprising a phase shifter gearing having an input drive element driven by a crankshaft of the internal combustion engine, an output drive unit which drives a camshaft of the internal combustion engine and an actuating element, by means of which a relative rotation between the drive input element and the drive output element can be realized by means of a device for imparting a braking torque, which is variable for normal operation, to the actuating element, whereby in the event of failure of the device and/or control thereof, an emergency running setting of the camshaft can be attained and maintained as a result of braking or respectively, arresting the actuating element.

An adjusting system of this type is described in DE 102 20 687 A1. With this adjusting system a servomotor is used, the stator of which is either connected in a fixed manner to the cylinder head, in which the camshaft is mounted, and the rotor of which acts on the input drive element of the phase shifter gearing, or its stator is connected to the input drive element in a fixed manner, whereby the rotor likewise acts on the actuating element of the phase shifter gearing. The servomotor may be designed as a permanent magnet servomotor or as a separately energized DC motor. With a servomotor in the form of a permanent magnet motor, the stator of which is connected to the cylinder head of the internal combustion engine in a rotationally fixed manner, the rotor must be actuated in such a manner that when in stationary operation, when, i.e., a predefined phasing of the input drive element, driven by the crankshaft of the internal combustion engine, as opposed to the output drive element, which drives the camshaft, has reached a predefined value, it rotates with the same rotational speed as the input drive element. In order to adjust the camshaft for "early" or "late," said rotor temporarily rotates out of phase at a speed which is slower or faster than that of the input drive element, until the desired phasing has been reached.

A servomotor of this type constructed as a permanent magnet motor has, according to DE 102 20 687 A1, a detent torque, which increases to a maximum from a central position in both rotational directions and subsequently drops off again. The detent torque is the maximal torque at which one can statically load an un-energized servomotor, without causing an irregular but continuous rotation. Said detent torque may be sufficient to cause the actuating element to be adjusted to an emergency running setting, if the voltage supply of the servomotor and/or the control thereof fails. If this detent torque is not sufficient to arrest the actuating element, an external braking torque must be applied by means of a cylinder head anchored mechanical or electric brake. With a stator rotating with the input drive element, this cylinder head anchored mechanical or electric brake is actually essential.

The construction of a servomotor of this type designed as a permanent magnet motor or as a separately excited DC motor is complicated and requires a complex control system. Because of the additionally required cylinder head anchored mechanical or electric brake, this construction is even more complex.

Furthermore, an adjusting device for a camshaft is known from the DE 103 55 560 A1, which has an input drive element driven by a crankshaft of the internal combustion engine, an output drive element which drives the camshaft and an actuating element, which is acted on by a brake having a braking force. By varying the braking torque at the actuating element, a relative rotation between the input drive element and the output drive element can be reached. For this, the design of the adjusting device allows for arbitrary phase angles between the input drive element and the output drive element. The brake is designed as a contactless functioning electromagnetic brake. Preferably, a hysteresis brake is used, the braking torque of which is independent of the rotational speed.

Further adjusting devices for a camshaft of an internal combustion engine are known from DE 10 2004 043 548 A1, DE 10 2004 033 522 A1 and DE 10 2006 011 806 A1. The adjusting device according to DE 10 2006 011 806 A1 has a braking system as well as a phase shifter gearing connected on the camshaft output drive side and the crankshaft of the internal combustion input drive side, whereby the phase shifter gearing for adjusting the camshaft diverts a portion of the input drive side energy to the braking system. According to a further characteristic of this known adjusting device, the braking system is designed as a friction locking braking system, whereby the necessary braking force is generated through a friction lining in a permanent slippage mode.

With this background information, the invention assumes the objective of creating an adjusting system for camshafts of an internal combustion engine having an emergency running function which is constructed in a simple manner and can be controlled easily.

An adjusting system for the objective mentioned above, comprises a phase shifter gearing having an input drive element driven by a crankshaft of the internal combustion engine, an output drive element which drives a camshaft of the internal combustion engine and an actuating element, by means of which a relative rotation between the drive input element and the drive output element can be realized by means of a device for imparting a braking torque, which is variable for normal operation, to the actuating element, whereby in the event of failure of the device and/or control thereof, an emergency running setting of the camshaft can be attained and maintained as a result of braking or respectively, arresting the actuating element. This objective is achieved in that a lining carrier of the device is located in an axially displaceable manner and rotationally fixed on one of the shafts supporting the actuating element, that a braking torque for normal operation can be modified by means of an electromagnet acting on the lining carrier against the force of a spring and functioning without contact, which is fixed in position and furthermore can be supplied with different voltages, and that the lining carrier can be pressed against a stationary counter-friction surface in the event of failure of the voltage supplied to the electromagnet and/or control thereof by means of the force applied by a spring and thereby enabling the emergency running setting to be applied.

With the adjusting system according to the invention, a servomotor is not necessary, accordingly, because the lining carrier, which is attached to the actuating element in a rotationally fixed manner, but is axially displaceable, is pressed against the stationary counter-friction surface in the event of failure of the voltage supplied to the electromagnet and/or control thereof, and as a result, the emergency running setting is applied.

During normal operation the electromagnet is supplied with voltage, the extent of which can be modified depending on the predefined phase angle between the crankshaft and the camshaft, wherein the contact pressure force of the spring against the stationary counter-friction surface is diminished to a greater or lesser degree, such that the actuating element can rotate in relation to the input drive element until the predefined phase angle has been reached.

In a second embodiment of the adjusting system according to the invention, the electromagnet is disposed such, in relation to the lining carrier and the counter-friction surface, that during normal operation the braking torque acting between the lining carrier and the counter-friction surface located opposite the lining carrier, generated as a result of charging the electromagnet with a modifiable voltage until the lining carrier rests fully against the counter-friction surface against the force of the spring, and the braking torque for the emergency running setting, in the event of a failure of the voltage supplied to the electromagnet and/or the control thereof, has been generated by pressing the lining carrier by means of the spring pressure against a stationary counter-friction surface located opposite the lining carrier.

In both variations, only an electromagnet which can be supplied with variable voltage is necessary, accordingly, in order to generate the variable braking torque for the adjustment of the phase angle, while the braking torque required to obtain the emergency running setting is achieved through a spring pressure.

Preferably, the phase shifter gearing is designed as a planetary gear assembly, having an input drive element consisting of a ring gear, with an output drive element consisting of a planet carrier, with planet gears and with an actuating element consisting of a sun gear, whereby the planet carrier has at least one arc shaped opening radially distanced from the rotational axle, whereby the ring element has at least one actuating projection projecting axially to engage in the opening, and with which end surfaces in the circumferential direction of the at least one opening form stops for the at least one actuating projection and represent the maximum adjustment positions of the camshaft in relation to the input drive element.

These maximum adjustment positions correspond to the maximal phase angles in the "early" and "late" directions, and one of these maximum adjustment positions also corresponds to the emergency running setting, which is then obtained when the voltage supply and/or the control of the electromagnet fails and the lining carrier is pressed against the stationary counter-friction surface as a result of spring pressure, while the opposite position is obtained when the lining carrier, as a result of the corresponding voltage supply the electromagnet makes no contact with the stationary counter-friction surface.

In the emergency running setting, the lining carrier rests with full spring pressure against the counter-friction surface, such that a corresponding braking torque is generated, which with a running internal combustion engine in said emergency running setting results in continuous friction and thereby, heating. In order to reduce this frictional heat and thereby the associated wear, it is possible to rotationally mount a pressure disk on the shaft for the actuating element designed as a sun gear, axially opposite the lining carrier, which is displaceable by means of the spring pressure, that engages at least one axially oriented actuating cam in the opening in the input drive element constructed as a planet carrier and thereby is coupled to the planet carrier in a rotationally fixed manner, but is axially displaceable, whereby one end region of a cam surface of the actuating cam, corresponding to the emergency running setting, is designed as a lowering in relation to the cam surface and accommodates the, at least one, actuating projection on the ring gear in the emergency running setting. As a result of this configuration, the spring pressure acting on the lining carrier, and thereby the braking torque, is reduced, such that when the emergency running setting has been reached, an overloading of the friction lining as a result of excessive heat is prevented.

If the lowered end region of the cam surface is structured as a ramp, the actuating projection which functions together with said lowered end region can run along the ramp to the point where the cam surface has been reached on the ring gear forming the output drive element when a corresponding electric voltage is supplied to the electromagnet and the torque acting on the phase shifter gearing is reversed. As a result, the pressure disk is axially displaced, whereby the phase angle between the input drive element and the output drive element can be altered at a constant input tension of the spring acting on the lining carrier.

The end region of the cam surface can also be designed as a locking pocket, in which the actuating projection, upon reaching the emergency running setting, even with occurring increased torques, for example breakaway torques, can be safely retained. In this case it is necessary to axially displace the pressure disk using external forces when the locking of the actuating projection on the ring gear in the locking pocket is to be released.

Figure 2:
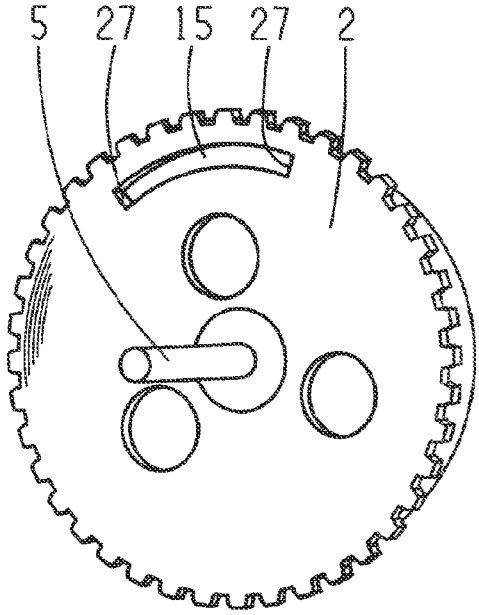
Figure 3:
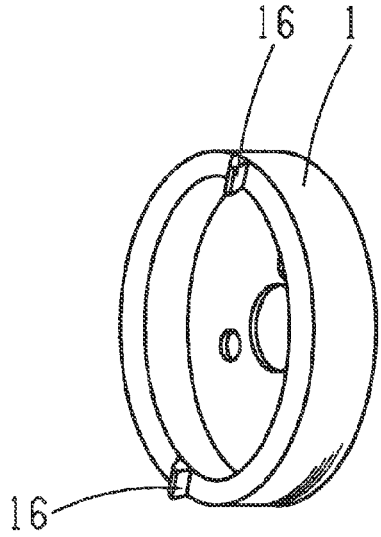

The invention shall be explained in greater detail based on two embodiments illustrated in the drawings. They show:

FIG. 1A schematic sectional view of an adjusting system according to the invention, according to a first embodiment, FIG. 2A perspective view of a planet carrier in an input drive element designed as a planetary gear assembly, FIG. 3A perspective view of a ring gear in an output drive element designed as a planetary gear assembly, FIG. 4A first embodiment of a pressure disk in an adjusting system according to FIG. 1, FIG. 5A second embodiment of a pressure disk in an adjusting system according to FIG. 1, and FIG. 6A schematic sectional view of a second embodiment of the adjusting system according to the invention.

The adjusting system according to FIG. 1 comprises a phase shifter gearing designed as a planetary gear assembly having a ring gear 1, forming the output drive element, with a planet carrier 2 having a sprocket to connect to a crankshaft of an internal combustion engine by means of a roller or sprocket chain, forming the input drive element, with planet gears 3 rotationally mounted on the bearing shafts 23 and with a sun gear 4 as an actuating element mounted on a central shaft 5. A camshaft 21 in the cylinder head of the internal combustion engine is powered by means of the output drive element 1. For this, the output drive element 1 is connected to the camshaft 21 by means of a threaded joint in a rotationally fixed manner.

A stationary component 6 of the internal combustion engine, which may be part of the cylinder head, supports a counter-friction surface 7 which functions together with a lining carrier 8 provided with a friction lining 9. The lining carrier 8 is disposed in a rotationally fixed manner to the shaft 5 against the force of a spring 10, which is designed as a disk spring in the embodiment illustrated, and mounted such that it can be axially displaced until it abuts a stop 28.

The axial displacement of the lining carrier 8 is affected by means of an electromagnet 11, which is disposed in the component 6 in a fixed manner. The stop 28 located on the shaft 5 limits the axial motion of the lining carrier 8 when voltage is supplied to the electromagnets 11 in such a manner that no contact occurs, and thereby no friction, between the lining carrier 8 and the electromagnets 11.

A pressure disk 12 is supported in a rotational manner on a rotationally fixed sleeve 17 by means of a rolling bearing 19, whereby the sleeve 17 can be axially displaced through the pressure of a spring 10 on the shaft 5. The pressure disk 12 meshes with diametrically opposed actuating cams 13 in arc shaped openings 15 of the input drive element 2. The extension of the actuating cams 13 in the circumferential direction corresponds to the extension of the openings 15 in the circumferential direction, such that the pressure disk 12 rotates together with the input drive element 2 essentially without play, but is however axially displaceable.

Diametrically opposed actuating cams are located on the face of the output drive element 1 designed as a ring gear which is facing the electromagnets 11, which also mesh with the openings 15. The openings 15 have end surfaces 27 which form stops for the actuating projections 16, such that the output drive element 1, in relation to the input drive element 2, can assume two maximal positions when the actuating projections 16 lie against one or the other end surface 27 of the openings 15. These maximal positions correspond to the maximum adjustment angle of the output drive element 1 in relation to the input drive element between the settings "late" and "early." One of the maximal positions also forms an emergency running setting.

Figure 4:
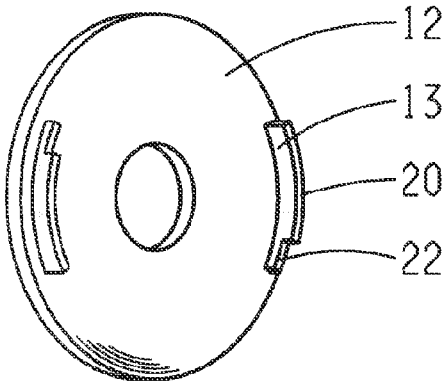

With the embodiment of the pressure disk 12 according to FIG. 4, a cam surface 20 of the actuating cam 13 ends in a lowering designed as a locking pocket 22, which in each case accommodates an actuating cam 16 in the locking position, such that the output drive element 1 and the input drive element 2 are coupled in a form-locking manner in the emergency running setting.

Figure 5:
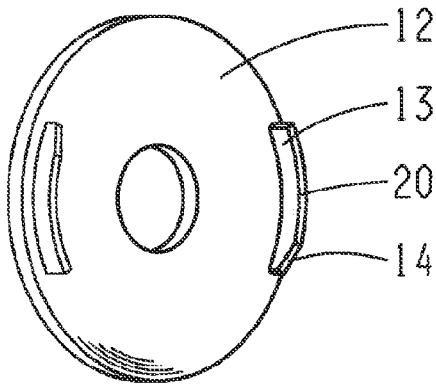

With the embodiment according to FIG. 5, the lowering at the end of the cam surface 20 is designed as a ramp 14, which in each case accommodates an actuating cam 16 in the locking position and enables a sliding release of the actuating cam 16 under specific conditions.

The output drive element 1 and the input drive element 2 are supported by means of rolling bearings 18 on the sun gear 4. The planet gears 3 mesh in the known manner through their gear teeth, on the one hand with the outer gear teeth of the sun gear 4 and on the other, with the inner gear teeth of the ring gear 1.

The mode of operation of the adjusting system according to FIG. 1 is as follows:

As long as the electromagnet 11 is not supplied with electric voltage, or the voltage supply of the electromagnet 11 or the control thereof fails, the friction lining 9 on the lining carrier 8 is pressed by means of the spring 10 against the stationary counter-friction surface 7. If the input drive element 2 then turns, then the sun gear 4 is held in place on the shaft 5 by means of the braking torque between the friction lining 9 and the counter-friction surface 7 and the camshaft 21 rotates with the input drive element 2 until the pressure disk 12, through the effect of the pressure of the spring 10, can axially displace the sleeve 17 and the actuating projections 16 mesh in the lowering formed by the ramp 14 or the locking pockets 22. Through the axial motion of the pressure disk 12 and the sleeve 17 the tension of the spring 10 is decreased resulting in a reduction of the friction torque between the counter-friction surface 7 and the friction lining 9, such that with the internal combustion engine running in the now-attained emergency running setting, a limited friction and thereby limited wear between the counter-friction surface 7 and the friction lining 9 occurs.

In order to return to the normal operating mode, when the electromagnet 11 is supplied with a variable voltage, with the embodiment according to FIG. 4, it is necessary to axially displace the pressure disk 12 towards the lining carrier 8 against the pressure of the spring 10. This can be carried out, for example, in a repair shop by a mechanic, or by means of an additional coil, which serves solely for the purpose of releasing said.

With the embodiment according to FIG. 5, it is sufficient to supply the electromagnets 11 with a sufficiently high voltage in order to fully lift the friction lining 9 on the lining carrier 8 from the counter-friction surface 7. Due to the resisting torque of the camshaft 21, the output drive element 1 has the tendency to move opposite the input drive element 2 in an angular position opposite the ramp, or respectively, the locking pocket 22. This means that in the embodiment example according to FIG. 5, the actuating projections 16 glide up the ramp 14 and can travel on the cam surface 20 up to the end stop 27 in the openings 15 of the planet carrier 2. Intermediate positions can be set in that the voltage supplied to the electromagnets 11 is reduced until one of the respective friction torques corresponding to an angular position between the counter-friction surface 7 and the friction lining 9 on the lining carrier 8 is set which exists during equilibrium of the resisting torque of the camshaft 21 occurring with a running internal combustion engine.

As a result of the axial displacement of the pressure disk 12 in the emergency running setting, a reduced friction torque results between the friction lining 9 on the lining carrier 8 and the counter-friction surface 7, whereby an overloading of the friction lining as a result of excessive heating is prevented. In reverse, the axial motion of the lining carrier 8 is limited by the stop 28 in such a manner that the lining carrier 8 does not reach the point where it abuts the electromagnets 11 when said is supplied with the maximal electric voltage and the friction lining 9 on the lining carrier 8 is fully lifted from the counter-friction surface 7, such that also no undesired friction can occur between the lining carrier 8 and the electromagnets 11. The lining carrier 8 and the spring 10 are mounted directly on the shaft 5, without additional support to the electromagnets 11, whereby further supports between the electromagnets 11 and the shaft 5 can be eliminated.

Figure 6:
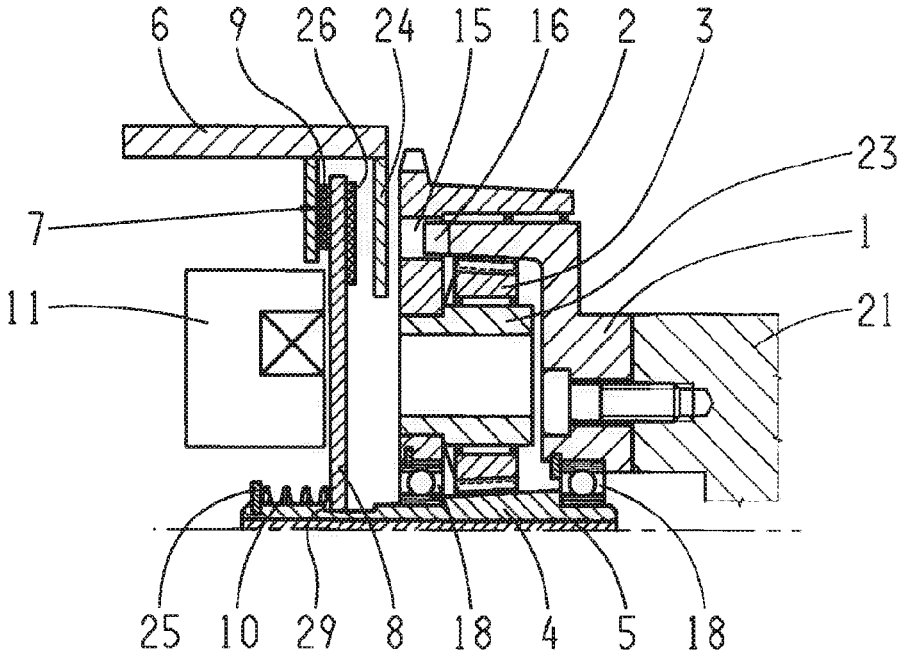

The embodiment according to FIG. 6 has, instead of the pressure disk 12, an additional counter-friction surface 24 on the stationary component 6, located in relation to the counter-friction surface 7, on the other side of the lining carrier 8, having a friction lining 9 on an axial side and on the opposite side having an emergency running friction lining 26.

The electromagnet 11 in this embodiment example is located on the side of the counter-friction surface 7 and pulls the lining carrier 8, against the pressure of the spring 10 which is supported by a stop 25 on the sun gear 4, against the counter-friction surface 7. In this case as well, a stop 29 on the sun gear 4 limits the axial displacement of the lining carrier 8 such that it does not come into contact with the electromagnets 11.

If no voltage is being supplied to the electromagnet 11, the spring 10 presses the lining carrier 8 with the emergency running friction lining 26 against the stationary counter-friction surface 24 such that due to the thereby resulting frictional torque, the emergency running setting of the ring gear 1, or respectively, of the camshaft 21, is assumed when the input drive element 2 is rotated. By supplying the electromagnets 11 with a variable electric voltage the friction lining 9 of the lining carrier 8 is pressed against the counter-friction surface 7 with greater or lesser degrees of force, whereby, as with the embodiment example according to FIG. 1, a predetermined frictional torque for adjusting the phase angle of the camshaft 21 to the respective target phase angle is generated and this phase angle is maintained. The maximal positions of the output drive element 1 in relation to the input drive element 2 are determined here as well by openings 15 in the input drive element 2 and actuating projections 16 on the output drive element 1, while intermediate positions are determined by the braking torque between the friction lining 9 on the lining carrier 8 and the counter-friction surface, which can be adjusted by means of the electromagnets 11.

The embodiments according to the FIGS. 1 and 6 provide that in the event of a failure of the voltage supply to the electromagnets 11 or the control thereof, a braking torque is generated by the pressure of the spring 10 in relation to the stationary component 6 of the internal combustion engine, which sets the camshaft 21 in the emergency running setting by means of the output drive element 1. Even if, as a result of the internal combustion engine stalling, first an intermediate setting of the camshaft 21 is given, through the turning over of the internal combustion engine by the starter motor, the emergency running setting will be reached in a short period of time, and a temporary operation of the internal combustion engine is possible in this emergency running setting.

The invention is not limited to the embodiments presented, but rather extends to all variants and equivalents of the invention defined by the patent claims.

REFERENCE SYMBOL LIST

1 Ring gear, output drive element
2 Sprocket, planet carrier, input drive element
3 Planet gears
4 Sun gear, actuating element
5 Shaft, rotational axle
6 Stationary component of the internal combustion engine
7 Counter-friction surface
8 Lining carrier
9 Friction lining
10 Spring
11 Electromagnet
12 Pressure disk
13 Actuating cam
14 Ramp
15 Opening
16 Actuating projection
17 Sleeve
18 Roller bearing
19 Roller bearing
20 Cam surface
21 Cam shaft
22 Locking pocket
23 Bearing shaft
24 Counter-friction surface
25 Stop
26 Emergency running friction lining
27 End surface
28 Stop
29 Stop

The invention claimed is:

1. An adjusting system for camshafts of an internal combustion engine having an emergency running function, comprising:

a phase shifter gearing with an input drive element driven by a crankshaft of an internal combustion engine;

an output drive element that drives a camshaft of the internal combustion engine;

an actuating element, and a pressure disk rotationally mounted on a shaft, wherein the drive input element is rotatable with respect to the drive output element by operation of a device for imparting a braking torque, wherein the braking torque applied to the actuating element is adjustable when the device is under normal operation, wherein the camshaft arrests the actuating element by braking when the device is under abnormal operation, wherein the actuating element is supported on a shaft and a lining carrier of the device is disposed in an axially displaceable and rotationally fixed manner on the shaft, wherein the braking torque is adjustable by operation of a stationary electromagnet acting on the lining carrier against a force of a spring in a contactless manner, wherein the stationary electromagnet is supplied with an adjustable voltage, wherein the spring exerts the force on the lining carrier against a stationary counter-friction surface upon failure to supply the adjustable voltage to the electromagnet, wherein the phase shifter gearing is planetary gear assembly, comprising:

the output drive element comprising a ring gear, the input drive element comprising a planet carrier, and at least one planet gears; and the actuating element comprising a sun gear, wherein the planet carrier has at least one arc shaped opening radially distanced from a rotational axle of the planet carrier, wherein the ring gear has at least one actuating projection extending axially and engaging in the arc shaped opening, and wherein end surfaces in a circumferential direction in the at least one arc shaped opening form stops for the at least one actuating projection, thereby representing a maximal adjustment positions of the camshaft in relation to the input drive element, wherein the pressure disk can be displaced by means of the pressure of the spring axially away from the lining carrier, wherein at least one actuating cam engages in the opening of the planet carrier and is thereby coupled with the planet carrier in a rotationally fixed but axially displaceable manner, wherein an end region with respect to the circumference of a cam surface of the actuating cam, and corresponding to the emergency running setting, is designed in relation to the cam surface as a lowered end region, and wherein the at least one actuating projection assumes the emergency running setting on the ring gear.

2. The adjusting system according to claim 1, wherein the electromagnet is configured to be able to fully lift the lining carrier from the counter-friction surface against the force of the spring by providing the different voltages such that the braking torque acting between the lining carrier and the counter-friction surface is adjustable through supplying the electromagnets with the different voltages from the point where the lining carrier has been fully lifted from the counter-friction surface to zero, and wherein, in the event of failure to supply the different voltages to the electromagnet, the lining carrier is pressed against the counter-friction surface by the force of the spring, thereby setting the emergency running setting.

3. The adjusting system according to claim 1, wherein the electromagnet is configured to generate the braking torque by pressing the lining carrier against a first surface of the counter-friction surface, which is located on a first side of the lining carrier, through supplying the electromagnets with the adjustable voltage to the point where the lining carrier lies fully against the counter-friction surface under pressure of the spring, and wherein in the event of failure to supply the adjustable voltage to the electromagnet the braking torque is generated by the spring through the pressing of the lining carrier against a second surface of the stationary counter-friction surface, which is located on a second side of the lining carrier.

4. The adjusting system according to claim 1, wherein the lowered end region is a ramp.

5. The adjusting system according to claim 1, wherein the lowered end region is a locking pocket.

6. An adjusting system for camshafts of an internal combustion engine having an emergency running function, comprising:

a phase shifter gearing with an input drive element driven by a crankshaft of an internal combustion engine;

an output drive element that drives a camshaft of the internal combustion engine; and an actuating element, wherein the drive input element is rotatable with respect to the drive output element by operation of a device for imparting a braking torque, wherein the braking torque applied to the actuating element is adjustable-when the device is under normal operation, wherein the camshaft arrests the actuating element by braking when the device is under abnormal operation, wherein the actuating element is supported on a shaft and a lining carrier of the device is disposed in an axially displaceable and rotationally fixed manner on the shaft, wherein the braking torque is adjustable by operation of a stationary electromagnet acting on the lining carrier against a force of a spring in a contactless manner, wherein the stationary electromagnet is supplied with an adjustable voltage, wherein the spring exerts the force on the lining carrier against a stationary counter-friction surface upon failure to supply the voltages to the electromagnet, wherein the phase shifter gearing is planetary gear assembly, comprising:

an output drive element comprising a ring gear, an input drive element comprising a planet carrier, and at least one planet gears; and an actuating element comprising a sun gear, wherein the planet carrier has at least one arc shaped opening radially distanced from a rotational axle of the planet carrier, wherein the ring gear has at least one actuating projection extending axially and engaging in the arc shaped opening, and wherein end surfaces in a circumferential direction in the at least one arc shaped opening form stops for the at least one actuating projection, thereby representing a maximal adjustment positions of the camshaft in relation to the input drive element.

7. The adjusting system according to claim 6, wherein the electromagnet is configured to be able to fully lift the lining carrier from the counter-friction surface against the force of the spring by providing the different voltages such that the braking torque acting between the lining carrier and the counter-friction surface is adjustable through supplying the electromagnets with the different voltages from the point where the lining carrier has been fully lifted from the counter-friction surface to zero, and wherein, in the event of failure to supply the different voltages to the electromagnet, the lining carrier is pressed against the counter-friction surface by the force of the spring, thereby setting the emergency running setting.

8. The adjusting system according to claim 6, wherein the electromagnet is configured to generate the braking torque by pressing the lining carrier against a first surface of the counter-friction surface, which is located on a first side of the lining carrier, through supplying the electromagnets with the adjustable voltage to the point where the lining carrier lies fully against the counter-friction surface under pressure of the spring, and wherein in the event of failure to supply the adjustable voltage to the electromagnet the braking torque is generated by the spring through pressing the lining carrier against a second surface of the stationary counter-friction surface, which is located on a second side of the lining carrier.

9. The adjusting system according to claim 6, further comprising:

a pressure disk rotationally mounted on a shaft, wherein the pressure disk can be displaced by means of the pressure of the spring axially away from the lining carrier, wherein at least one actuating cam engages in the opening of the planet carrier and is thereby coupled with the planet carrier in a rotationally fixed but axially displaceable manner, wherein an end region with respect to the circumference of a cam surface of the actuating cam, and corresponding to the emergency running setting, is designed in relation to the cam surface as a lowered end region, and wherein the at least one actuating projection assumes the emergency running setting on the ring gear.

10. The adjusting system according to claim 9, wherein the lowered end region is a ramp.

11. The adjusting system according to claim 9, wherein the lowered end region is a locking pocket.

12. An adjusting system for camshafts of an internal combustion engine having an emergency running function, comprising:

a phase shifter gearing with an input drive element driven by a crankshaft of an internal combustion engine;

an output drive element that drives a camshaft of the internal combustion engine; and an actuating element, wherein the drive input element is rotatable with respect to the drive output element by operation of a device for imparting a braking torque, wherein the braking torque applied to the actuating element is adjustable when the device is under normal operation, wherein the camshaft arrests the actuating element by braking when the device is under abnormal operation, wherein the actuating element is supported on a shaft and a lining carrier of the device is disposed in an axially displaceable and rotationally fixed manner on the shaft, wherein the braking torque is adjustable by operation of a stationary electromagnet acting on the lining carrier against a force of a spring in a contactless manner, wherein the stationary electromagnet is supplied with an adjustable voltage, wherein the spring exerts the force on the lining carrier against a stationary counter-friction surface upon failure to supply the adjustable voltage to the electromagnet, wherein the electromagnet is configured to generate the braking torque by pressing the lining carrier against a first surface of the counter-friction surface, which is located on a first side of the lining carrier, through supplying the electromagnets with the adjustable voltage to the point where the lining carrier lies fully against the counter-friction surface under pressure of the spring, wherein in the event of failure to supply the adjustable voltage to the electromagnet the braking torque is generated by the spring through pressing the lining carrier against a second surface of the stationary counter-friction surface, which is located on a second side of the lining carrier, wherein the phase shifter gearing is planetary gear assembly, comprising:

an output drive element comprising a ring gear, an input drive element comprising a planet carrier, and at least one planet gears; and an actuating element comprising a sun gear, wherein the planet carrier has at least one arc shaped opening radially distanced from a rotational axle of the planet carrier, wherein the ring gear has at least one actuating projection extending axially and engaging in the arc shaped opening, and wherein end surfaces in a circumferential direction in the at least one arc shaped opening form stops for the at least one actuating projection, thereby representing a maximal adjustment positions of the camshaft in relation to the input drive element.

13. The adjusting system according to claim 12, wherein the electromagnet is configured to be able to fully lift the lining carrier from the counter-friction surface against the force of the spring by providing the different voltages such that the braking torque acting between the lining carrier and the counter-friction surface is adjustable through supplying the electromagnets with the different voltages from the point where the lining carrier has been fully lifted from the counter-friction surface to zero, and wherein, in the event of failure to supply the different voltages to the electromagnet, the lining carrier is pressed against the counter-friction surface by the force of the spring, thereby setting the emergency running setting.

14. The adjusting system according to claim 12, further comprising:

a pressure disk rotationally mounted on a shaft, wherein the pressure disk can be displaced by means of the pressure of the spring axially away from the lining carrier, wherein at least one actuating cam engages in the opening of the planet carrier and is thereby coupled with the planet carrier in a rotationally fixed but axially displaceable manner, wherein an end region with respect to the circumference of a cam surface of the actuating cam, and corresponding to the emergency running setting, is designed in relation to the cam surface as a lowered end region, and wherein the at least one actuating projection assumes the emergency running setting on the ring gear.

15. The adjusting system according to claim 14, wherein the lowered end region is a ramp.

16. The adjusting system according to claim 14, wherein the lowered end region is a locking pocket.

* * * * *

UNITED STATES PATENT AND TRADEMARK OFFICE

CERTIFICATE OF CORRECTION

PATENT NO. : 8,651,076 B2
APPLICATION NO. : 13/128833
DATED : February 18, 2014
INVENTOR(S) : Walliser et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 137 days.

Signed and Sealed this
Twenty-ninth Day of September, 2015

Michelle K. Lee

Michelle K. Lee
*Director of the United States Patent and Trademark Office*